US007748805B2

(12) United States Patent
Lucas et al.

(10) Patent No.: US 7,748,805 B2
(45) Date of Patent: Jul. 6, 2010

(54) MEANS FOR PROVIDING ADJUSTMENT TO BINS AND SHELVES IN REFRIGERATORS

(75) Inventors: Alan Stevenson Lucas, Evansville, IN (US); Jason Robert Yochum, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 276 days.

(21) Appl. No.: 11/329,895

(22) Filed: Jan. 11, 2006

(65) Prior Publication Data

US 2007/0159041 A1 Jul. 12, 2007

(51) Int. Cl.
*A47B 96/04* (2006.01)

(52) U.S. Cl. ..... 312/405.1

(58) Field of Classification Search ..... 248/221.11, 248/222.13, 222.11, 222.51, 22.51; 312/405, 312/405.1, 408, 404, 351, 319.1, 332.1; 211/103, 211/187, 190, 207
See application file for complete search history.

(56) References Cited

U.S. PATENT DOCUMENTS

| | | | | |
|---|---|---|---|---|
| 2,746,828 | A | 5/1956 | Amore | 312/214 |
| 2,984,533 | A | 5/1961 | Sundberg | |
| 2,998,290 | A | 8/1961 | Sharpe | |
| 4,033,540 | A | 7/1977 | Hamblin | 248/246 |
| 4,138,175 | A | 2/1979 | Tattershall | 312/270 |
| 4,174,486 | A | 11/1979 | Winkler | 312/138 R |
| 4,537,379 | A | 8/1985 | Rhoades | 248/222.2 |
| 4,815,685 | A * | 3/1989 | Roberts et al. | 248/221.11 |
| 4,829,653 | A * | 5/1989 | Stich | 29/458 |
| 5,042,398 | A * | 8/1991 | Lau et al. | 108/108 |
| 5,199,778 | A | 4/1993 | Aoki et al. | 312/408 |
| 5,322,366 | A * | 6/1994 | Revlett et al. | 312/405.1 |
| 5,370,455 | A * | 12/1994 | Sedovic et al. | 312/405.1 |
| 6,425,259 | B2 | 7/2002 | Nelson et al. | 62/344 |
| 6,582,038 | B2 | 6/2003 | Moreno-Olguin et al. | 312/405.1 |
| 2004/0080247 | A1 * | 4/2004 | Dobler et al. | 312/348.1 |
| 2004/0149872 | A1 * | 8/2004 | Giles et al. | 248/226.11 |

* cited by examiner

*Primary Examiner*—Janet M Wilkens
*Assistant Examiner*—Matthew W Ing
(74) *Attorney, Agent, or Firm*—Kirk W. Goodwin; Greer, Burns & Crain Ltd

(57) ABSTRACT

A support element for use with a refrigerator, the support element having a support surface with a rear edge, at least two support arms located on the support element and being laterally spaced from one another, with the support arms extending rearwardly of the rear edge and being laterally biased.

20 Claims, 8 Drawing Sheets

MEANS FOR PROVIDING ADJUSTMENT TO BINS AND SHELVES IN REFRIGERATORS

BACKGROUND OF THE INVENTION

The present invention relates generally to refrigerators and in particular to storage bins and shelves in the refrigerator.

Refrigerators having storage bins and shelves in the door are well known, as are arrangements for permitting the adjustability of the position of the bins or shelves. For example, U.S. Pat. No. 2,746,828 discloses a refrigerator with an arrangement for securing shelves in the door of the refrigerator at selected heights, by engaging ends of the shelves in pockets formed by a trim element on the door interior, and securing the shelves at a desired height with threaded fasteners engaging tabs depending from the shelves and engaging into apertures provided at discrete locations in the door panel.

U.S. Pat. No. 6,582,038 discloses a storage bin mounting system for a refrigerator door in which side walls of the bin engage with side ribs in the door and spaced recesses in the door liner receive movable tab members carried on the bin to hold the bin in selected discrete positions on the door. Each bin must be assembled onto the door at a top end of the side ribs, and then slid downwardly into place before another bin can be assembled onto the door. Removal of the bins would occur in the reverse order.

Other shelving arrangements are known for refrigerators including the use of shelf ladders with discretely spaced openings for positioning the shelves within the refrigerators, or complicated gearing arrangements for moving shelves to intermediate positions, such as disclosed in U.S. Pat. Nos. 2,998,290 and 5,199,778.

U.S. Pat. No. 4,537,379 discloses a shelving arrangement in which a plurality of shelving standards are provided with vertical slots. A number of support members are inserted individually into the slots, and then pivoted into a locked position. Shelf support brackets are then mounted onto the support members, followed by the placement of shelves on the shelf support brackets. Care must be taken to horizontally align the various support members with each other at each position that a shelf is to be located.

It would be an improvement in the art if a support element were provided for a refrigerator allowing for easy attachment of the support element, and flexible positioning of the support element on the door of the refrigerator.

SUMMARY OF THE INVENTION

In an embodiment, the present invention provides a support element for use with a refrigerator, the support element having a support surface with a rear edge, at least two support arms located on the support element and being laterally spaced from one another, with the support arms extending rearwardly of the rear edge and being laterally biased.

In an embodiment, the support arms may be laterally biased by a separate biasing element positioned between the arms and a portion of the support element.

In an embodiment, the separate biasing element may comprise a spring.

In an embodiment, the support arms may be pivotally mounted to the support element.

In an embodiment, the support arms may have a vertical extent of at least one half inch.

In an embodiment, a portion of the support arms extending rearwardly of the rear edge include a tooth projecting from an end of the arm.

In an embodiment, the portions of the support arms extending rearwardly of the rear edge are biased inwardly towards each other.

In an embodiment, a support element is provided for use with a refrigerator having an interior liner, the refrigerator liner having at least two vertically oriented channels arranged therein. The support element may include a support surface with a rear edge arranged to engage the refrigerator liner, a support arm located on each lateral side of the support element, with the support arms extending rearwardly of the rear edge and being laterally biased such that a portion of the support arms will project into the channels in the liner and be pressed against a side wall of the channels.

In an embodiment, the support surface may be one of shelves, bins, half width bins, hooks, clips, sealed bins, diary bins and can holders.

In an embodiment, a refrigerator is provided including an interior door liner, the liner having at least two vertically oriented channels formed therein, a support element having a support surface and a rear edge arranged to engage the liner, a support arm located on each lateral side of the support element, with the support arms extending rearwardly of the rear edge and being laterally biased such that a portion of the support arms will project into the channels in the liner and be pressed against a side wall of the channels.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
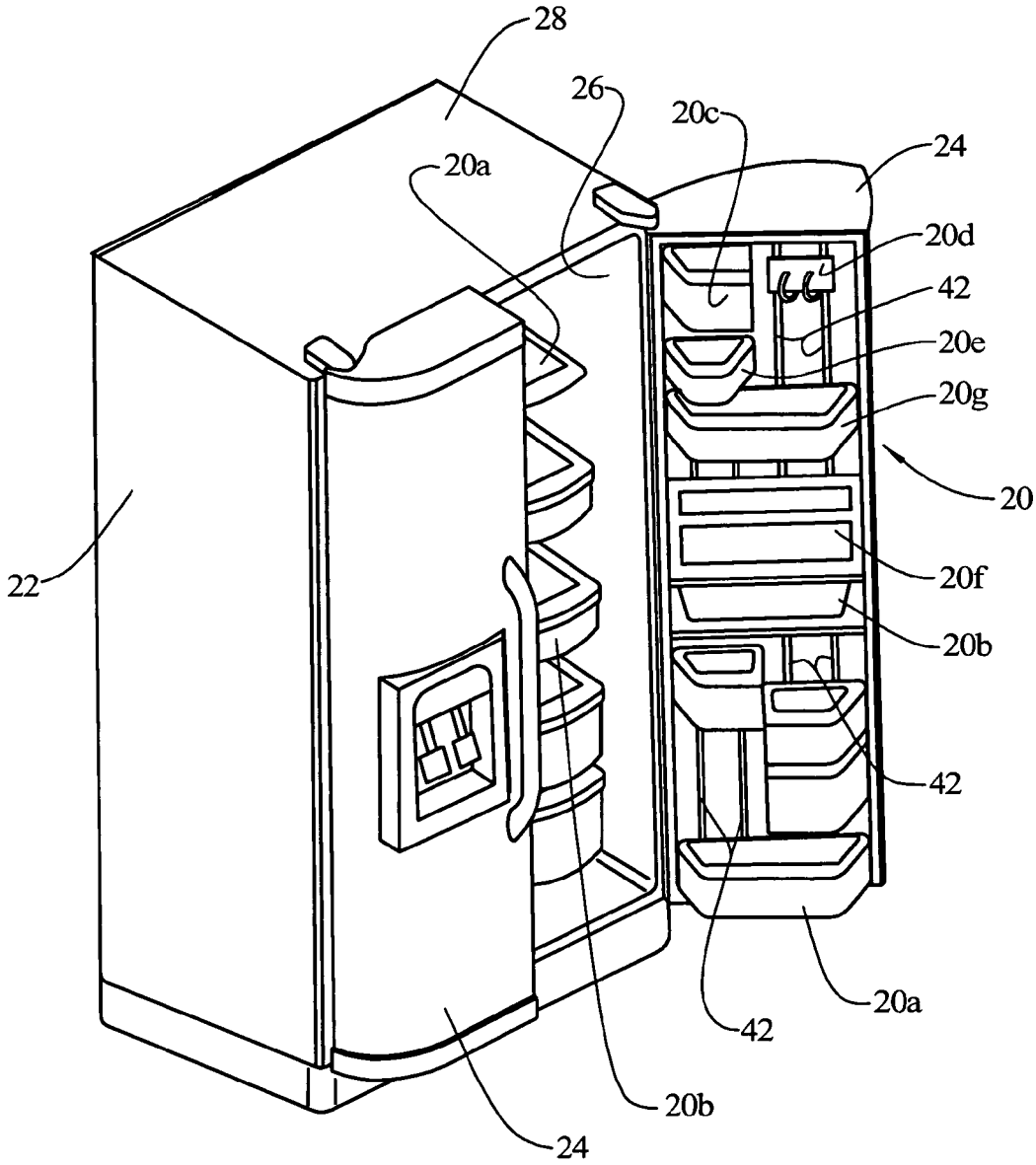
FIG. 1 is a perspective view of a refrigerator embodying the principles of the present invention.

As illustrated in FIG. 1, the present invention provides a support element 20 for use with a refrigerator 22. The refrigerator 22 includes one or more doors 24 which may be opened to provide access to a refrigeration compartment 26 in a cabinet 28 of the refrigerator. The support element 20 may comprise a shelf 20*a*, a full width bin 20*b*, a half width bin

20*c*, storage hooks 20*d*, resealable containers 20*e*, dairy bins 20*f*, can holders 20*g*, and other elements designed to support food and other items within the refrigerator 22, such as supporting them on the door 24 of the refrigerator or supporting them within the refrigeration compartment 26 on one of the interior walls of the refrigerator.

Figure 2:
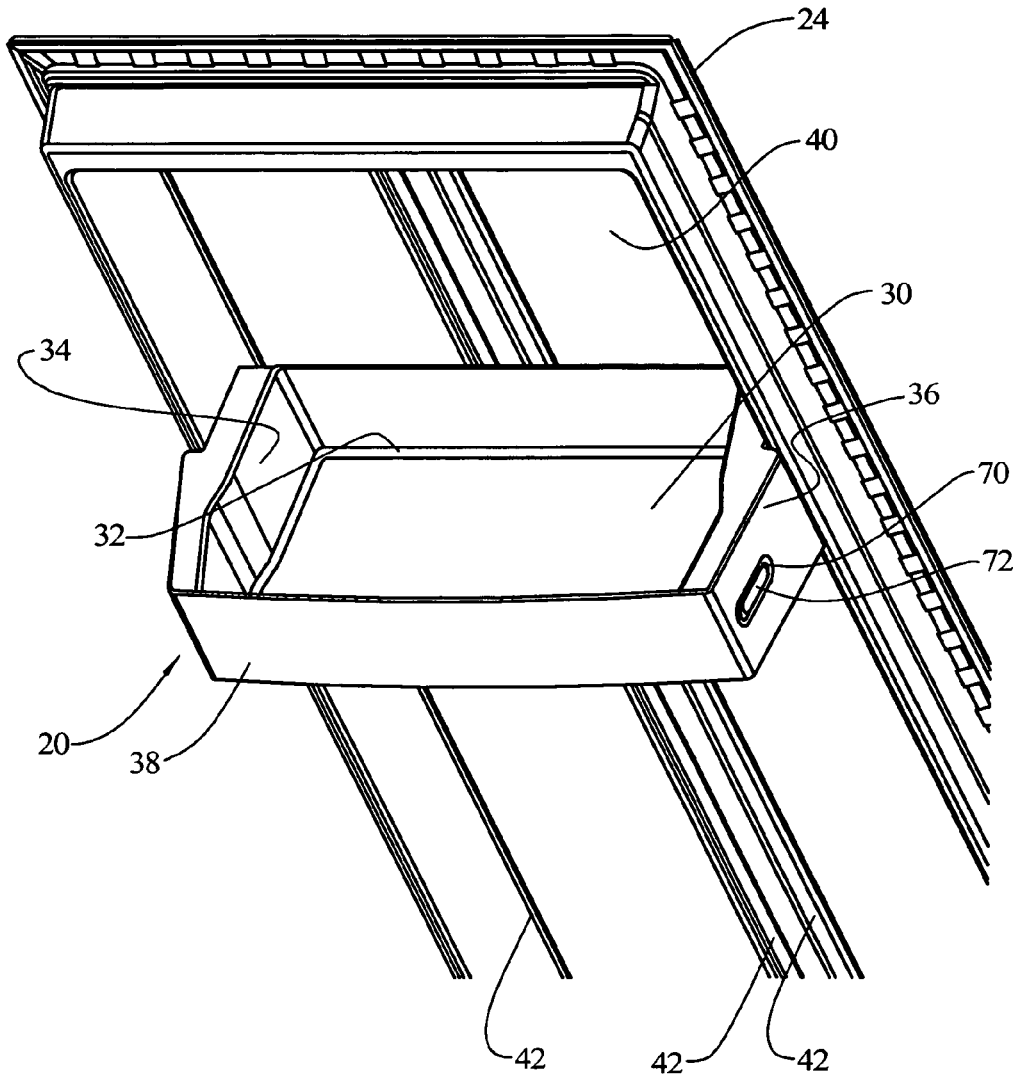
FIG. 2 is a top perspective view of an inside of the refrigerator door with a support element mounted on the door.

An embodiment of the support element 20 is shown in greater detail in FIG. 2, and may include a substantially horizontal support surface 30 with a rear bottom edge 32, two lateral side walls 34, 36 and a front wall 38. The horizontal support surface 30 primarily supports the items on the door 24 of the refrigerator 22 (or other interior wall of the refrigerator), while the two lateral side walls 34, 36 and the front wall 38 serve to hold the items in place as the door is opened and closed. The support element may be a one-piece molded plastic part, or it may be made of multiple pieces which snap together, or are held together with fasteners.

Figure 3:
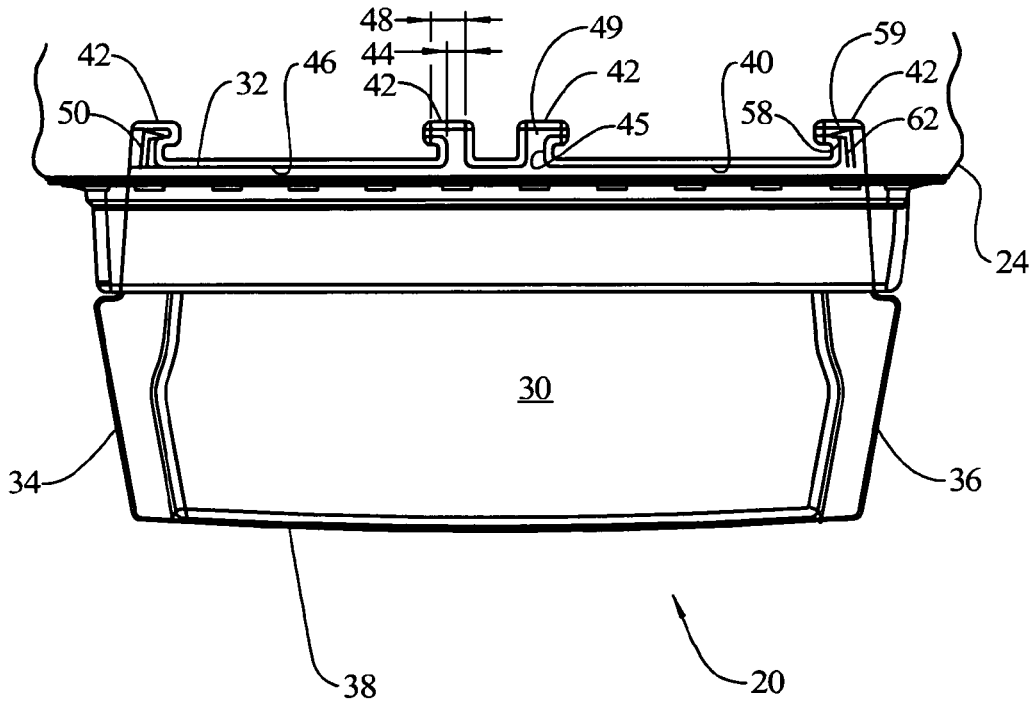
FIG. 3 is a partial top elevational view of the refrigerator liner and support element.

Typically the refrigerator is provided with an interior liner 40, both on the door(s) 24 of the refrigerator, as well as forming the interior walls of the refrigeration compartment 26. In an embodiment of the invention, the liner 40 is provided with at least two, and perhaps four or more vertical channels 42. These channels 42 may extend virtually the entire height of the liner 40, or may be provided in one or more segments of the height, but less than the total height. The channels 42 may have a cross section as illustrated in FIG. 3, with a relatively narrow width 44 defined by side walls 45 of the channel at a surface 46 of the liner 40 and a relatively wider width 48 at a recessed portion 49 of the channel. The channels 42 may be formed with the liner 40, such as in a thermoforming process, or the channels may be extruded separately, such as of plastic or aluminum, or may be roll formed, such as roll formed steel. In either of these two latter cases, the channels 42 would be arranged on the liner 40 separately.

Figure 4:
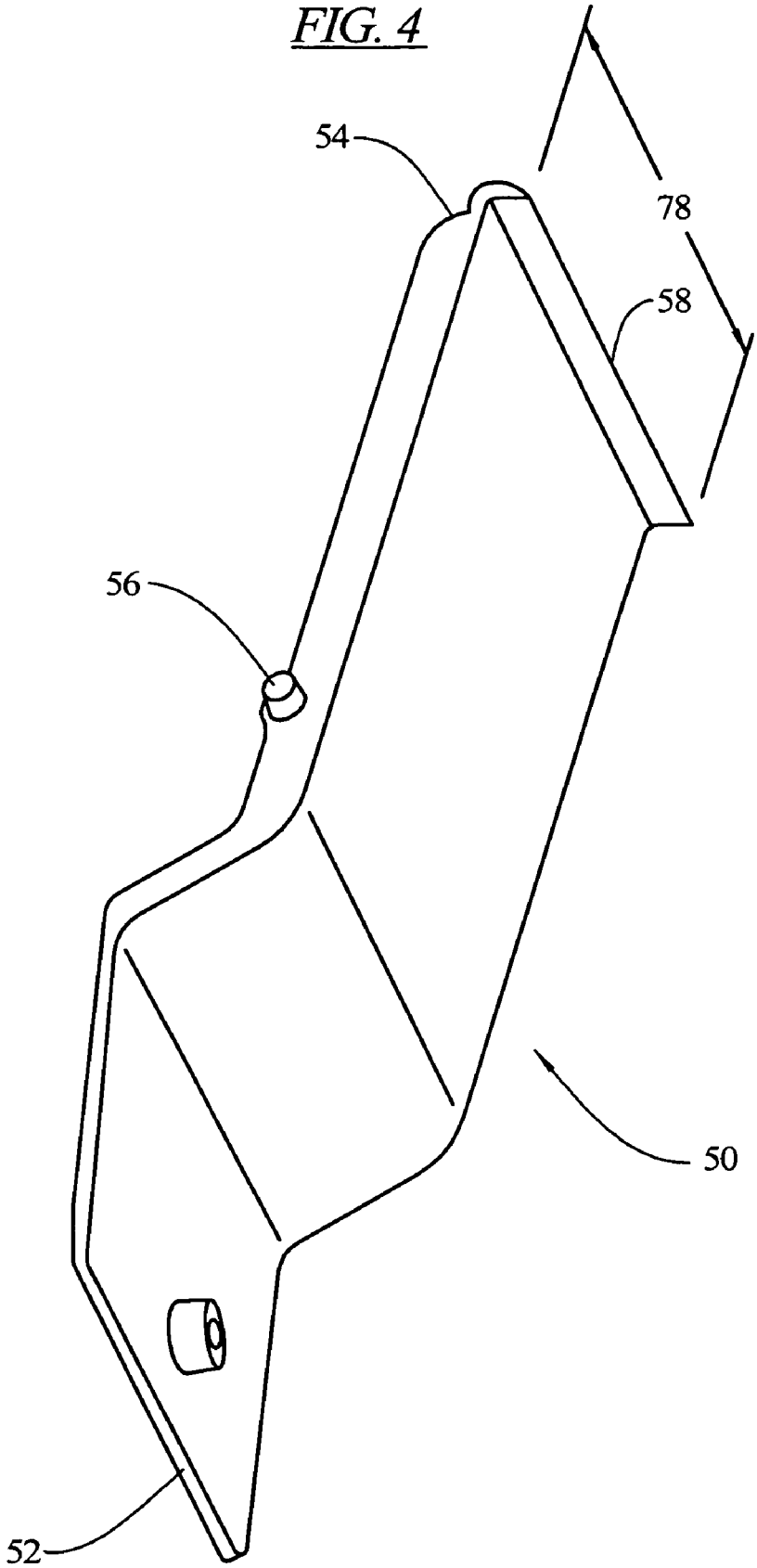
FIG. 4 is a top inside perspective view of a support arm.
Figure 5:
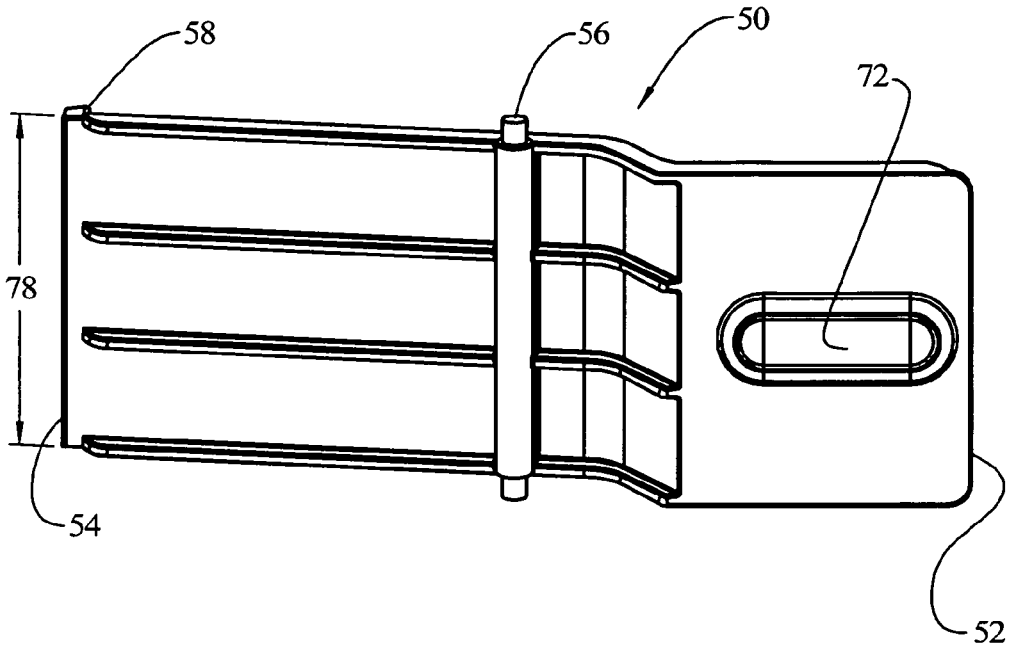
FIG. 5 is a top outside perspective view of the support arm of FIG. 4.
Figure 6:
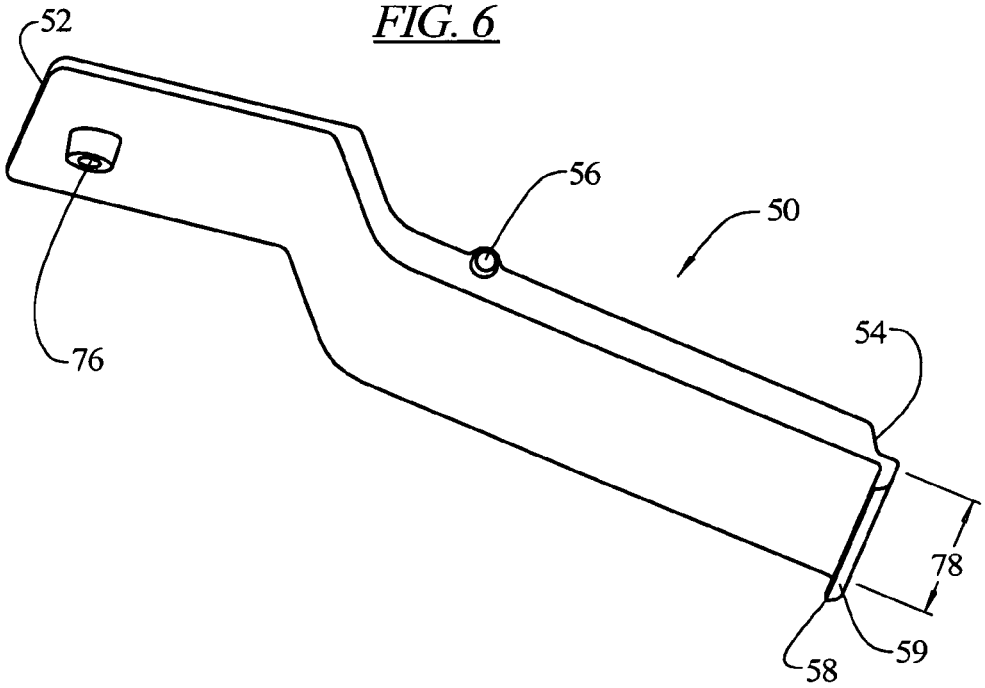
FIG. 6 is a top inside perspective view of the support arm of FIG. 4.

The support element 20 may include a support arm 50, shown in isolation in FIGS. 4-6. The support arm 50 has a first forward end 52 and a second rearward end 54. Between the two ends 52, 54 is located a pivot pin 56. The support arm 50 may be provided with a tooth 58 which projects from the second end 54 and which may be provided with a sloped rear surface 59, whose purpose is discussed below.

Figure 7:
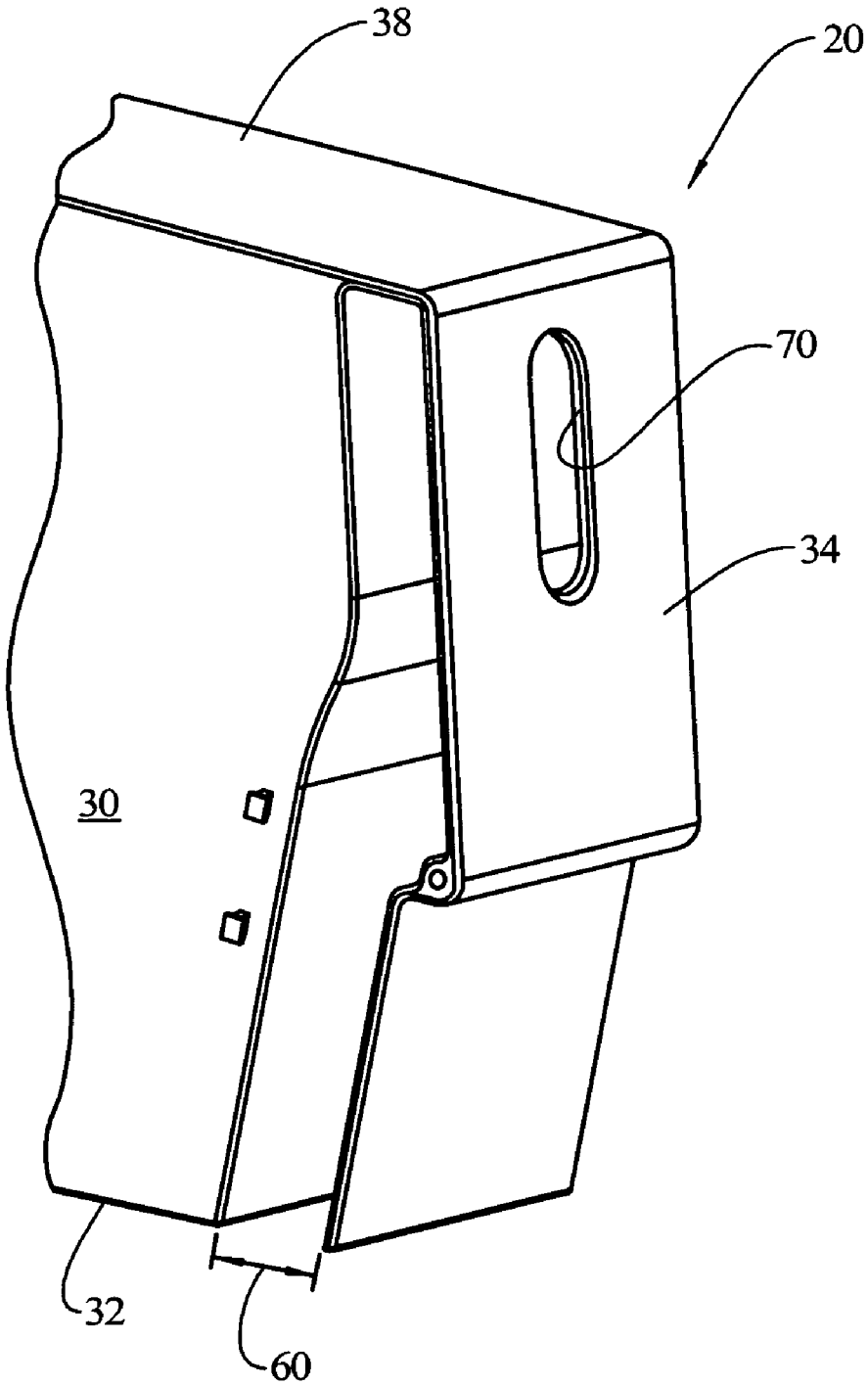
FIG. 7 is a partial bottom elevational view of the support element.
Figure 8:
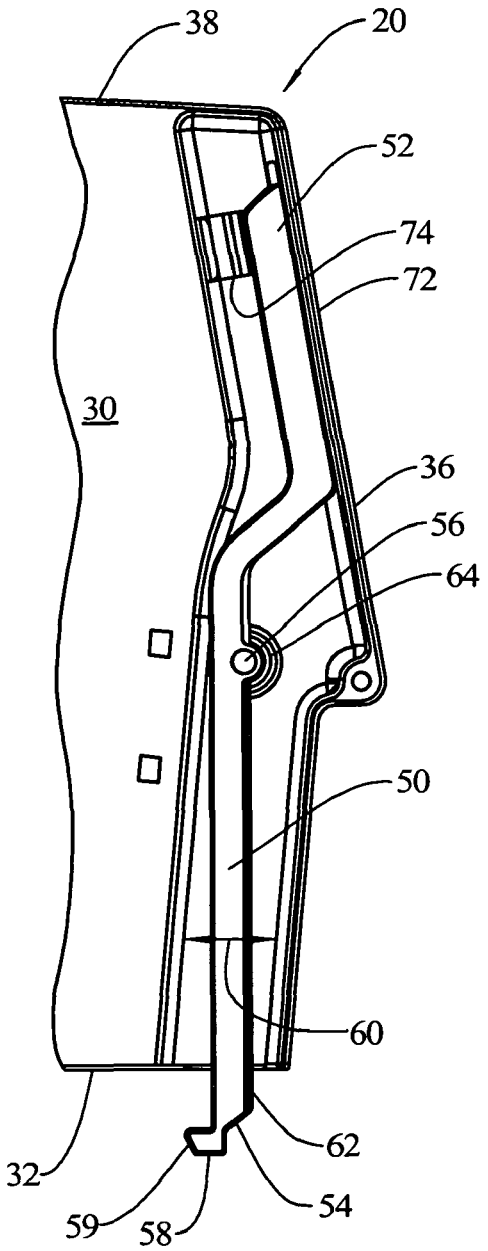
FIG. 8 is a bottom elevational view of a the support element and attached support arms.
Figure 9:
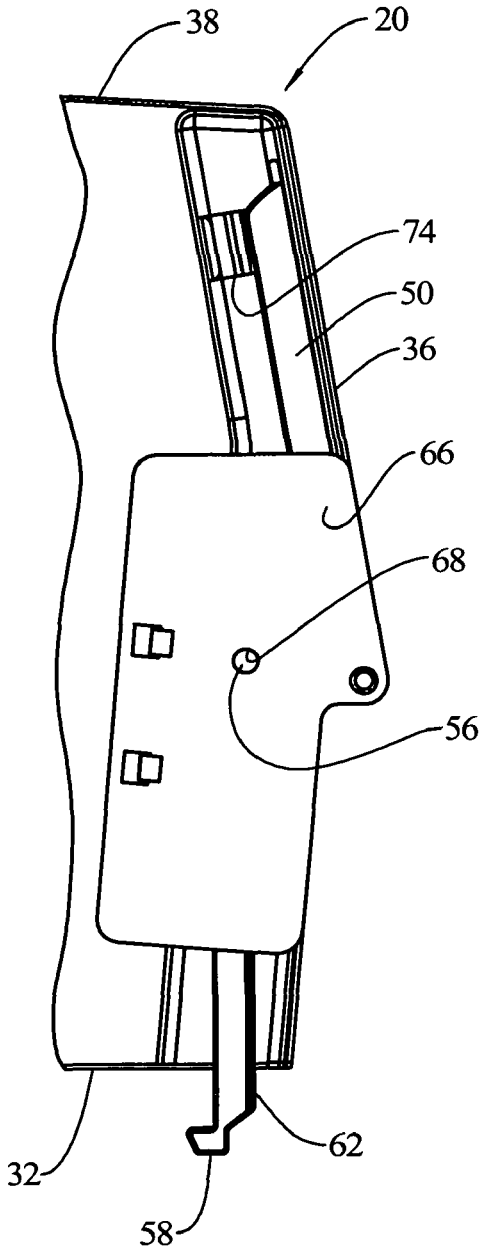
FIG. 9 is a bottom elevational view of a the support element and attached support arms with an attached bottom piece.

The side walls 34, 36 of the support element 20 may be provided as double walls with a space 60 in between, as illustrated in FIGS. 7 and 8. A portion of the support arm 50 is received in the space 60 of the side walls 34, 36 and a portion 62 of the support arms extends rearwardly of the rear edge 32 of the support surface 30. The pivot pin 56 may be captured in a vertical orientation in a detent 64 (FIG. 8) on the support element 20, such as a boss with a recessed center to receive the pivot pin 56, a hole, a solid boss or pin to be received in a recess in the pivot pin, or other similar arrangements. A sheet metal or plastic part 66 (FIG. 9) may be attached to a lower end of each side wall 34, 36 to cover the support arms 50 to prevent the user from seeing or touching the arms. This bottom part 66 may be provided with a detent 68 such as detent 64 to capture a bottom portion of the pivot pin 56 to help ensure good alignment of the support arm 50. The detent 68 in the bottom part 66 may be a hole, a boss with either a recess or solid, or other arrangement.

Figure 10:
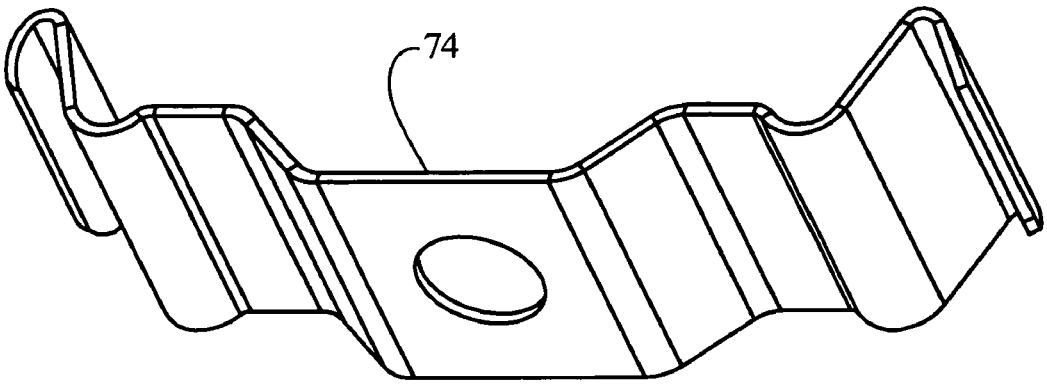
FIG. 10 is an isolated perspective view of the biasing element in the form of a spring.
Figure 11:
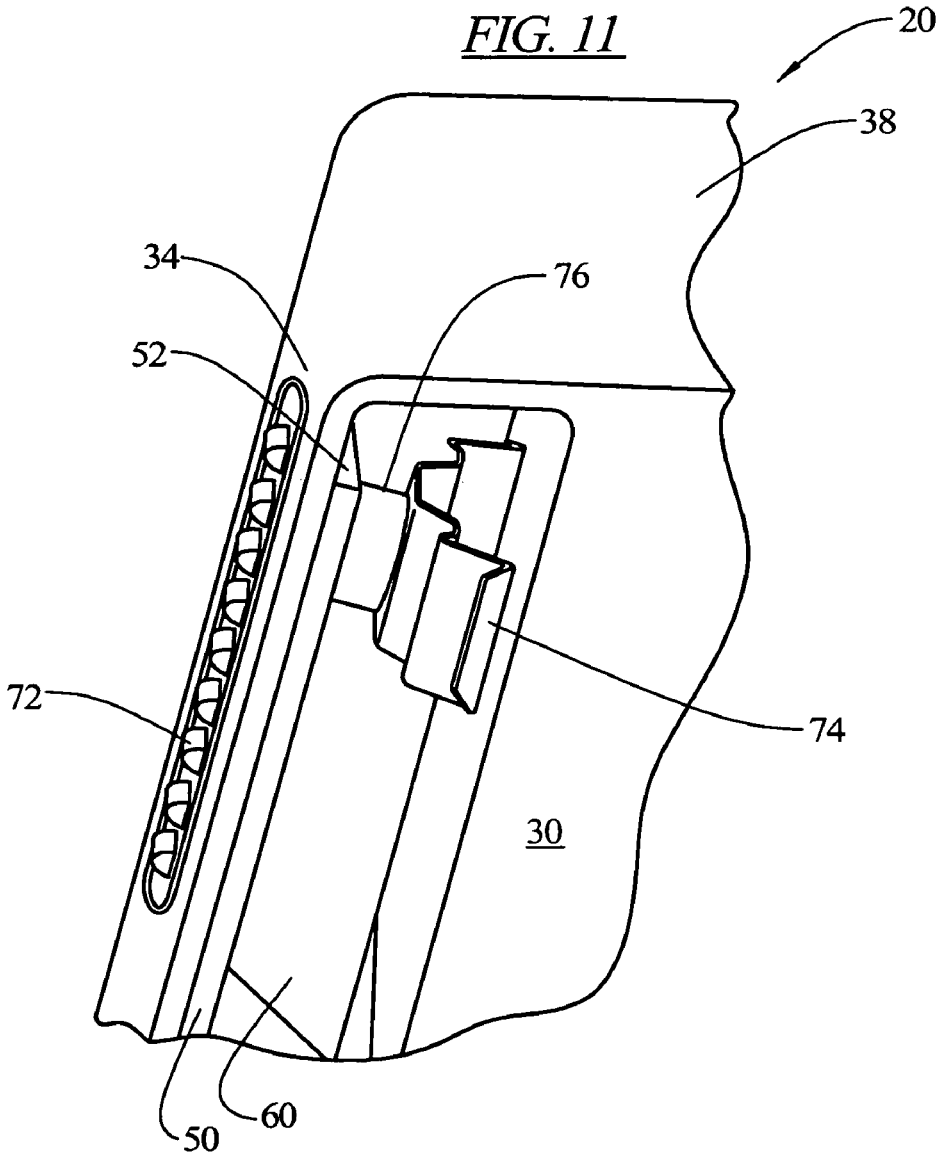
FIG. 11 is a partial bottom perspective view of the support element, support arm and biasing element.

The side walls 34, 36 may each contain a window 70 through which a pad portion 72 of the support arms 50 is exposed. The pad portion 72 may be manually engaged by a user to move or remove the support element 20 as described below. A biasing element 74, shown in isolation in FIG. 10, may be positioned between each of the support arms 50 the lateral side wall 34, 36 that the support arm is mounted adjacent to, as shown in FIGS. 8 and 11. This biasing element 74, which may be in the form of a spring, may be captured on a boss 76 or other locating element on the support arm 50 (FIG. 11) so as to bias the rearward end 54 of each of the support arms laterally. A manual engagement and pressing action against the pad portion 72 of the support arm 50 will act against the biasing element 74 to overcome the lateral bias and to pivot the support arm in an opposite lateral direction.

Thus, the present invention provides a support element 20 for use with a refrigerator 22 having an interior door liner 40, and the refrigerator liner having at least two vertically oriented channels 42 formed therein. In an embodiment, the support element 20 includes the support surface 30 with the rear bottom edge 32 arranged to engage the refrigerator liner 40. The support arms 50 may be located at each lateral side of the support element, with the support arms extending rearwardly of the rear edge 32 and being laterally biased such that the rear portion 62 of the support arms will project into the channels 42 in the liner 40 and be pressed against the side wall 45 of the channels.

A width or thickness of the support arms 50, at least in the region of the rear portion 62 is less than the width 44 of the channel opening so that the rear portion of the support arms will be readily received in the channels 42 when the support element 20 is moved into engagement with the refrigerator liner 40. In the embodiment illustrated, the rear portions 62 of the two support arms 50 are biased laterally towards each other and the teeth 58 formed at the rearward ends 54 of the support arms face each other. This arrangement could also be reversed with the support arms 50 being biased laterally away from each other and the teeth 58 also extending away from each other. As the rear portion 62 of the support arms 50 are moved into the channels 42, the rear portions are forced laterally away from each other, which movement is assisted by the sloped surface 59 of the tooth 58. Once the tooth 58 moves into the recessed portion 49 of the channel 42, which is slightly wider, the rear portions 62 of the support arms 50, which are biased towards each other, move towards each other due to a pivoting movement of the support arms, and the rear portion of the support arms press against the side walls 45 of the channels 42 and the tooth is captured behind a side wall of the channel (FIG. 3).

The support element 20 is then held on the door 24 or other wall of the refrigerator 22 in a cantilevered manner. The support element 20 engages the liner 40 at the rear bottom edge 32, and the friction of the support arms 50 engaging the channels 42 prevent the support element from slipping downwardly on the door 24 or other wall, even while carrying a load of food or other items. The support element 20 is prevented from pivoting about the rear bottom edge 32 by the engagement of the teeth 58 with the wall of the channel 42. In order to prevent the support element 20 from being dislodged, particularly in an upward direction, such as when it is struck from below, the support arms 50 may have a height 78 exceeding half an inch, and perhaps exceeding an inch, so that a vertical extent of the teeth 58 engaging the walls 45 of the channels 42 will provide the necessary wedging action to prevent the dislodging from occurring. The engagement of the support arms 50 with the channels 42 and engagement of the rear edge 32 with the liner 40 provide the sole vertical support for the support element 20 on the door 24.

The support element 20 may be inserted at any height of the channels 42 and need not be inserted from the top or some other specific location as is the drawback with other shelving systems. The support element 20 may also be moved to virtually any vertical position on the channels, allowing the user to completely customize the placement and arrangement of support elements in the door of their refrigerators 22. To accommodate different arrangements of support elements 20, there may be provided more than two vertical channels 42, such as four vertical channels, so that half width support elements can be supported and moved past one another in a side-by-side arrangement.

The support elements 20 are moved or removed by the user manually pressing on the pad portions 72 of the support arms 50 to overcome the bias of the biasing element 74 and thereby releasing the frictional engagement between the support arms and the channel 42. The support element 20 may then be moved vertically, either up or down, or removed horizontally away from the refrigerator liner 40 so as to completely remove the support element from the door 24 or other supporting wall.

Although the support arms 50 are illustrated as being positioned at the lateral sides of the support element 20, they may also be located at other positions, such as arranged below the support surface 30 and spaced apart less than a full width of the support element. The biasing force could be overcome by a lateral force by the user or by a forward or rearward force, with an appropriate arrangement of pivots, levers, wheels, gears, or other force and motion transfer mechanisms. The support arms 50 may also be attached to the support element 20 in a manner other than in a pivoting manner. For example, the support arms 50 may be made of a flexible and resilient material such that they are biased into a position by their own resiliency, and may be flexed by the application of a manual force to release a frictional engagement between the support arms and the channel walls 45. The cross-sectional shapes of the channels 42 may also vary from those shown in the drawings, including completely open channels in which the opening at the liner surface 46 is the same width or a greater width than the recessed portion 49. In such cases, in lieu of or in addition to the teeth 58 on the support arms 50, other friction enhancing elements, such as rubber pads, or other known arrangements may be provided.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. In other embodiments, different combinations of components than those combinations specifically shown and described could be used. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A food item support element for use with a refrigerator having an interior liner, the liner having at least two laterally spaced apart and vertically oriented channels arranged therein, the channels being defined by vertical channel side walls spaced apart from one another by a width, said support element comprising:

a substantially horizontal support surface extending laterally substantially a full width of said support element and having two lateral ends, said support surface being sized and arranged to vertically support a food item, with a rear edge arranged to engage the liner, lateral side walls located at each lateral end of said support surface and extending upwardly above said support surface, and a plurality of support arms with at least one support arm located adjacent each lateral end of said support surface, said support arms being pivotally mounted to a wall of said support element with a portion of each support arm extending forwardly of the pivot mounting and a portion extending rearwardly of said rear edge and being laterally biased such that a portion of each of said support arms will project into the channels in the liner and be pressed against one of the side walls of each of the channels.

2. A food item support element according to claim 1, wherein said support surface is selected from the group consisting of shelves, bins, half width bins, hooks, clips, sealed bins, diary bins and can holders.

3. A food item support element according to claim 1, wherein said support arms are pivotally mounted by means of pivot pins engaged in detents on said support element.

4. A food item support element according to claim 1, wherein said support arms have a vertical extent of at least one half inch.

5. A food item support element according to claim 1, wherein said portions of said support arms extending rearwardly of said rear edge each includes a tooth projecting laterally from an end of the support arms.

6. A food item support element according to claim 1, wherein said portions of said support arms extending rearwardly of said rear edge are biased inwardly towards each other.

7. A food item support element according to claim 1, where said support arms have a manually engageable portion arranged to permit a manual application of lateral force to overcome said lateral bias while said support element is held on said liner.

8. A refrigerator comprising:

an interior liner, said liner having at least two vertically oriented channels arranged therein, said channels being defined by vertical channel side walls spaced apart from one another by a width and a vertical channel opening extending continuously along a majority of a height of said liner, a food item support element having a substantially horizontal support surface sized and arranged to vertically support a food item, lateral side walls located at each lateral side of said support element and extending upwardly above said support surface and a rear edge arranged to engage said liner, a support arm located on each lateral side of said support element, said support arms extending rearwardly of said rear edge and being laterally biased such that a portion of each of said support arms will project into said vertical channel openings of said channels in said liner at a user selected vertical location in said channel and be pressed against one of said side walls of said channels, the continuous vertical channel openings permitting the support element to be moved to and supported at different user selected vertical positions along the height of said liner while said support arms continuously remain projecting into said vertical channel openings to allow the user to customize the placement and arrangement of said support element relative to said liner.

9. A food item support element according to claim 1, wherein a spring positioned between a wall of said support element and said arm and captured on a boss provides said lateral bias.

10. A refrigerator according to claim 8, wherein engagement of said support arms with the side walls of the vertically oriented channels and engagement of said rear edge with the interior liner provide the sole vertical support for said support element on the liner.

11. A refrigerator according to claim 8, wherein said support arms are pivotally mounted to said support element.

12. A food item support element for use with a refrigerator, comprising:

a substantially horizontal support surface extending laterally substantially a full width of said support element and having two lateral ends, said support surface being sized and arranged to vertically support a food item, said support surface having a rear edge, lateral side walls located at each lateral end of said support surface and extending upwardly above said support surface, each of said lateral walls being formed as a pair of double walls with a space at each lateral end of said support surface between each pair of double walls, said space being open to a rear of said support element, at least two support arms located on said support element and being partially positioned in said spaces between said pairs of double walls of said side walls, said support arms being laterally spaced from one another, said support arms extending rearwardly through the rear openings of said spaces beyond said rear edge and being laterally biased.

13. A food item support element according to claim 12, wherein said support arms are laterally biased by a separate biasing element positioned between said arms and a portion of said support element.

14. A food item support element according to claim 13, wherein said separate biasing element comprises a spring captured on a boss.

15. A food item support element according to claim 12, wherein said support arms are pivotally mounted to said support element.

16. A food item support element according to claim 12, wherein said support arms have a vertical extent of at least one half inch.

17. A food item support element according to claim 12, wherein a portion of said support arms extending rearwardly of said rear edge includes a tooth projecting laterally from a rear end of the arm.

18. A food item support element according to claim 12, wherein said portions of said support arms extending rearwardly of said rear edge are biased inwardly towards each other.

19. A food item support element for use with a refrigerator, comprising:

a substantially horizontal support surface extending laterally substantially a full width of said support element and having two lateral ends, said support surface being sized and arranged to support a food item, said support surface having a rear edge, lateral side walls located at each lateral end of said support surface and extending upwardly above said support surface, each of said lateral walls being formed as a pair of double walls with a space at each lateral end of said support surface between each pair of double walls, said space being open to a rear of said support element, and a front wall, a support arm extending from a forward end to a rearward end pivotally mounted at each lateral side of said support element in said spaces between said double walls of said side walls and having a portion at said rearward end extending through said rear opening of said spaced to terminate rearwardly of said rear edge, each support arm carrying a vertical pivot pin intermediate ends of each support arm pivotally engaged with detents on said support element, a biasing element positioned between each of said support arms and one of said lateral side walls and captured on a boss extending from one of said lateral side walls to bias said rearward end of each of said support arms laterally, and a tooth projecting laterally from said rearward end of said arm.

20. A food item support element according to claim 19, wherein said portions of said support arms extending rearwardly of said rear edge are biased inwardly towards each other.

* * * * *